US006276395B1

(12) United States Patent
Poncelet et al.

(10) Patent No.: US 6,276,395 B1
(45) Date of Patent: Aug. 21, 2001

(54) PROCESSING INSTALLATION FOR RINSING WATER HAVING AN INDEPENDENT RECYCLING FILTERING DEVICE

(75) Inventors: Olivier Poncelet, Chalon sur Saone; Gilles Clavellier, Creteil; Pierre Thevenet, La Chapelle de Bragny, all of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/638,333

(22) Filed: Aug. 14, 2000

(30) Foreign Application Priority Data

Apr. 5, 2000 (FR) ..... 00 04358

(51) Int. Cl.[7] ..... G03D 3/06

(52) U.S. Cl. ..... 137/563; 137/565.33; 137/565.35; 137/571; 396/626

(58) Field of Search ..... 137/563, 565.3, 137/565.33, 565.35, 571; 396/626

(56) References Cited

U.S. PATENT DOCUMENTS

| | | | | |
|---|---|---|---|---|
| 2,833,374 | * | 5/1958 | Glasser | 137/563 X |
| 3,056,500 | * | 10/1962 | Carter | 137/563 X |
| 3,166,095 | * | 1/1965 | Gegenheimer et al. | 137/563 |
| 3,332,435 | * | 7/1967 | Anderson et al. | 137/563 X |
| 3,851,662 | * | 12/1974 | Jessop | 137/563 |
| 4,295,913 | * | 10/1981 | Purr et al. | 137/563 X |
| 4,312,586 | * | 1/1982 | Ohtani | 137/563 X |
| 4,324,481 | * | 4/1982 | Becherer | 137/563 X |
| 4,421,399 | * | 12/1983 | Steube | 137/563 X |
| 4,506,986 | * | 3/1985 | Freeman | 137/563 X |
| 4,705,379 | * | 11/1987 | Kobayashi et al. | 137/563 X |
| 5,018,551 | * | 5/1991 | Pelissier | 137/571 |
| 5,054,519 | * | 10/1991 | Berman | 137/563 |
| 5,057,858 | * | 10/1991 | Woog | 137/563 X |
| 5,203,367 | * | 4/1993 | Akai et al. | 137/101.25 |
| 5,933,674 | * | 8/1999 | Fyson | 396/626 |

FOREIGN PATENT DOCUMENTS

DE 423 204 C 12/1925 (DE) .

* cited by examiner

*Primary Examiner*—John Rivell
(74) *Attorney, Agent, or Firm*—David M. Woods

(57) ABSTRACT

The processing installation comprises a processing machine 12 provided with a tank 14 and a recycling device 22 linked to the tank 14 by a feeding pipe 26 enabling a first pump 24 firmly attached to the recycling device 22 to take the liquid from the tank with a set flow rate, to treat the liquid taken and to send the treated liquid back to the tank through a return pipe 28. The feeding pipe has at least one zone that is situated at a lower level than the tank level and that is provided with two conduits 30 and 32 arranged parallel, and a second pump 34 arranged on one of the two conduits 30 as to automatically un-primed the first pump 24.

1 Claim, 1 Drawing Sheet

PROCESSING INSTALLATION FOR RINSING WATER HAVING AN INDEPENDENT RECYCLING FILTERING DEVICE

FIELD OF THE INVENTION

The present invention relates to the environment and more particularly to the treatment of liquids in processing machines.

It is known to reduce spent liquids by making it circulate continuously in recycling devices to enable its reuse.

BACKGROUND OF THE INVENTION

In photography the regulations relating to the disposal of spent water have become more restrictive. It has been suggested to treat the rinsing water so as to be able to recycle it inside the machine in order to reduce the water flows and trap the silver freed during processing. To adapt the operation of machines manufactured prior to the introduction of the new rules and to make them compatible with these new regulations, an independent filtering device has been suggested that connects to the processing installation. In particular this device comprises a treatment tank equipped with a pump enabling spent water to be taken from the rinsing tank and then after treatment to be sent back to the rinsing tank. This device is arranged outside the processing machine.

In the embodiment of the invention that is intended to be utilized on machines for developing X-ray plates the rinsing water contains silver ions and gelatin particles. The recycling device that is used comprises a first type of filter to trap the silver ions in order to limit the concentration to a value less than the regulatory threshold and a second type of filter enabling the gradual release of a biocide so as to inhibit the growth and/or proliferation of microorganisms. To efficiently treat the rinsing waters, the flow rate of the pump is adapted to the volume of the rinsing tank to make the whole volume contained in the tank circulate every few minutes.

For various reasons, especially the processing machine maintenance, the design of certain machines currently on the market or the arrangement of the filtering device in relation to the machine, unpriming of the pump may occur. This phenomenon causes the normal operation of the filtering device to stop, which in turn causes poor functioning of the processing machine.

The invention aims to avoid this disadvantage.

SUMMARY OF THE INVENTION

The processing installation, in accordance with the invention is equipped with a tank containing a processing liquid as well as a recycling device for this liquid; this recycling device is linked to the tank by a feeding pipe enabling a first pump firmly attached to the recycling device to take the liquid from the tank at a set flow rate, to treat the liquid taken and to send the treated liquid back to the tank through a return pipe. This installation is characterized in that the feeding pipe has at least one zone situated at a lower level than the tank level and that is provided with two conduits arranged parallel, and a second pump arranged on one of the two conduits.

BRIEF DESCRIPTION OF THE DRAWINGS

The foregoing and other objects, features, and advantages of the invention will be apparent from the following more particular description of the preferred embodiments of the invention, as illustrated in the accompanying drawing.

DETAILED DESCRIPTION OF THE INVENTION

Figure 1:
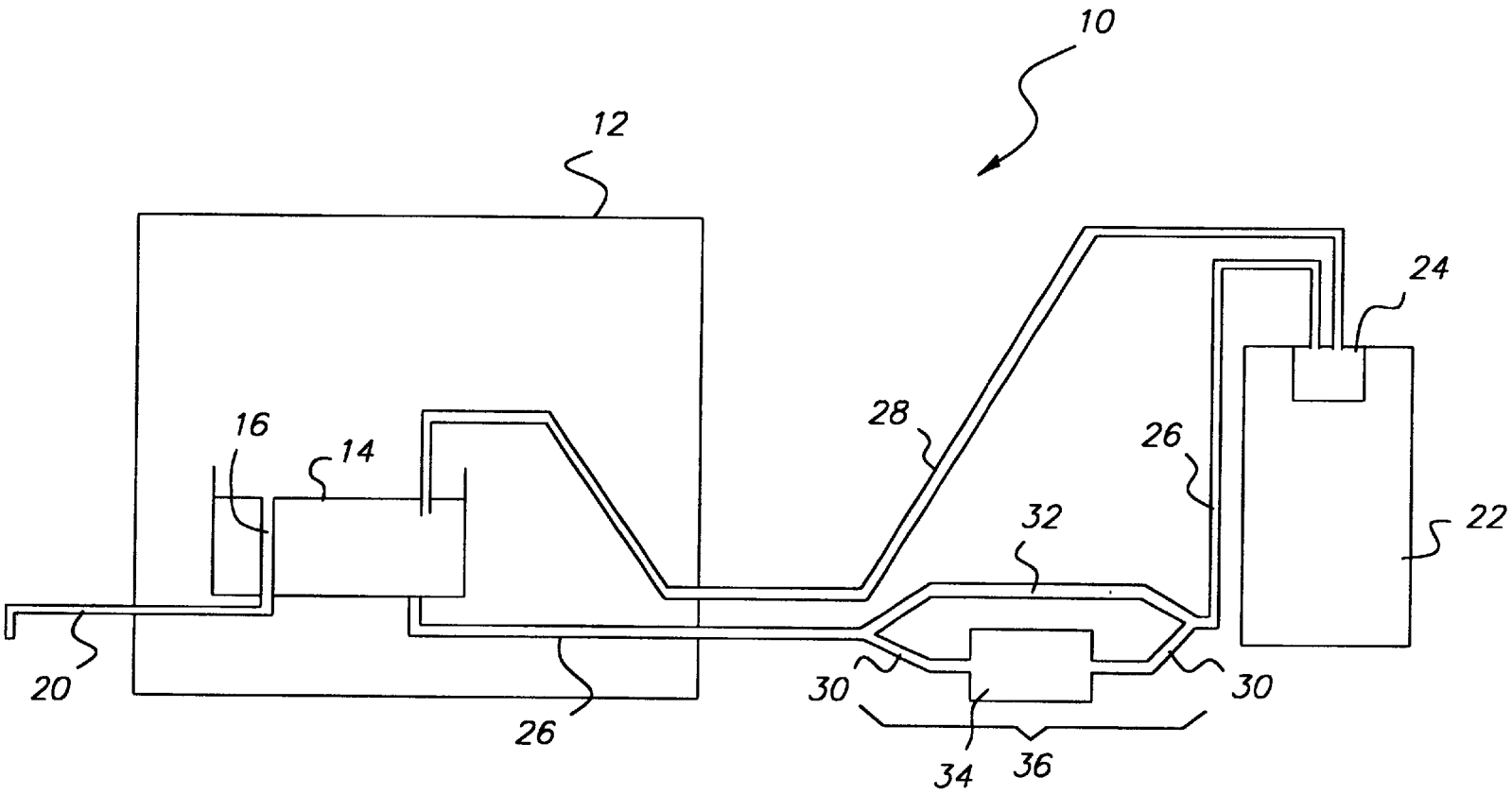
FIG. 1 shows a processing installation.

The following is a detailed description of the preferred embodiment of the invention wherein reference 10 represents a processing installation. In particular this installation comprises a photographic processing machine symbolized by the box 12. This processing machine will not be described in detail for it may take the form of any currently known photographic processing machine such as for example the Ektascan Laser Printer™ or the Kodak X-Omat 5000RA™ sold by Kodak® or the XP515™ developing device sold by 3M® or the Curix Compact Plus™ processor sold by Agfa®.

These processing machines comprise a rinsing tank 14, through which the film passes before the final drying. This tank generally comprises an overflow device 16 that enables the volume of solution contained in the rinsing tank to be kept even. Usually, for each quantity of film passing through the rinsing tank a set amount of refill water is added. The surplus water leaves the rinsing tank 14, through the overflow 16 and by the waste pipe 20, and is sent to the drains.

It has already been suggested to reduce the water flow rates by recycling the rinsing water. In order to achieve this, the tank 14 is linked to a recycling device 22 via a feeding pipe 26 and a return pipe 28. A pump 24 continuously circulates the water that is taken from the rinsing tank 14 and the water reaches the recycling device 22 through the feeding pipe 26. Advantageously the feeding pipe 26 is linked to the tank 14 near the bottom of this tank 14.

During maintenance of the installation or when the layout of the room in which the installation is situated requires the recycling device to be a distance away or again when this layout is such that the level of the recycling device is situated above the tank level, the pump may become unprimed. In these conditions the recycling device no longer performs its function and the processing provided by the installation is no longer optimal.

The invention proposes to provide a remedy to this situation.

The pump 24 becomes re-primed because of the introduction of air into the feeding pipe 26. Therefore the invention proposes to modify the feeding pipe to be able to automatically reintroduce enough water in the feeding pipe 26 so that the pump 24 is re-primed. Therefore there is at least one zone 36 of the feeding pipe below the bottom level of the rinsing tank to feed this zone with water by gravity from the rinsing tank. In this zone 36 of the feeding pipe 26 there is a second pump 34 that forces the flow towards the first pump 24 controlling the recycling device 22. To adapt the flow rate provided by the second pump 34 to that of the first pump 24, the feeding pipe has in the zone 36 two branches 30 and 32 arranged parallel. The second pump 34 is arranged on one of the branches 30 or 32. The branch connections shown on the drawing are "Y" shaped. Clearly "T" connections can also be used in which the two branches can be linked to the upper bar of the "T" or in which any one of the branches is linked to the vertical bar of the "T". Any one of these arrangements enables the flow provided by the second pump 34 to be completely cleared provided that the flow is enough to supply sufficient water to the first pump 24 to re-prime it. Indeed if the flow of the second pump 34 is less than the flow of the first pump 24, the second branch 32 will provide an additional flow to the pump 24. If the flow of the second pump 34 is more than the flow of the first pump 24, the additional flow leaving the second pump will be sent back by the branch 32 towards the inlet of this second pump 34.

Such a branching device ensures the re-priming of the first pump 24 independently of its position as soon as the rinsing tank contains its constant volume of water.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PART LIST

10 Processing installation
12 Box
14 Tank
16 Overflow device
20 Waste pipe
22 Recycling device
24 First pump
26 Feeding pipe
28 Return pipe
30 Branch
32 Branch
34 Second pump
36 Zone

What is claimed is:

1. A processing installation equipped with a tank containing a processing liquid and a recycling device for this liquid, which recycling device is linked to the tank through a feeding pipe enabling a first pump firmly attached to the recycling device to take liquid from the tank with a set flow rate, to treat the liquid taken and to send back the treated liquid to the tank through a return pipe, characterized in that the feeding pipe has at least one zone that is situated at a lower level than the tank level and that is provided with two conduits arranged parallel, and a second pump arranged on one of the two conduits.

* * * * *